US007773922B2

(12) United States Patent
Nishino et al.

(10) Patent No.: US 7,773,922 B2
(45) Date of Patent: Aug. 10, 2010

(54) IMAGE FORMING APPARATUS

(75) Inventors: Yoshiro Nishino, Toride (JP); Kenji Suzuki, Abiko (JP); Tomoharu Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 12/234,951

(22) Filed: Sep. 22, 2008

(65) Prior Publication Data

US 2009/0097872 A1 Apr. 16, 2009

(30) Foreign Application Priority Data

Oct. 11, 2007 (JP) ..... 2007-265028

(51) Int. Cl.
*G03G 15/09* (2006.01)
*G03G 15/08* (2006.01)

(52) U.S. Cl. ..... 399/274; 399/284

(58) Field of Classification Search ..... 399/53, 399/56, 274, 284
See application file for complete search history.

(56) References Cited

U.S. PATENT DOCUMENTS 3,951,542 A 4/1976 Ito et al.
4,625,676 A * 12/1986 Sakamoto et al. ..... 399/274
6,278,849 B1 * 8/2001 Kawasaki ..... 399/284 X
6,339,686 B2 * 1/2002 Yamanaka et al. ..... 399/274 X
6,836,634 B2 * 12/2004 Byun et al. ..... 399/284
7,269,382 B2 9/2007 Hashimoto

FOREIGN PATENT DOCUMENTS

JP 3-38669 A 2/1991
JP 7-44014 A 2/1995
JP 11-231645 A 8/1999
JP 2005-70497 A 3/2005
JP 2006-208579 A 8/2006

* cited by examiner

*Primary Examiner*—Sandra L Brase
(74) *Attorney, Agent, or Firm*—Fitzpatrick, Cella, Harper & Scinto

(57) ABSTRACT

An image forming apparatus for developing an electrostatic image formed on a photosensitive drum 1 with a developer, so as to form an image includes: a rotatable developing sleeve 44; a developing blade 46 for restricting a layer of a developer borne on the developing sleeve 44; developing member for developing the electrostatic image formed on the photosensitive drum 1 with the developer; vibrating member 50 for vibrating the developing blade 46; and control member for controlling a drive condition of the vibrating means 50 according to a printing ratio of the image formed.

5 Claims, 6 Drawing Sheets

IMAGE FORMING APPARATUS

BACKGROUND OF THE INVENTION

1. Field of the Invention

The present invention relates to an image forming apparatus, in which an image is formed by developing an electrostatic image formed on an image bearing member with a developer.

2. Description of the Related Art

In an image forming apparatus using an electrophotographic system, a developing device for developing an electrostatic image formed on an image bearing member has been conventionally exemplified by a developing device using a two-component developer including non-magnetic toner particles (i.e., a toner) and magnetic carrier particles (i.e., a carrier). Such a two-component developer need not include a magnetic material in a toner, and therefore, has been widely used in, particularly, a color image forming apparatus for reasons of a good tint and the like.

In the above-described developing device for use in the image forming apparatus, a developer contained inside of a development container is agitated and conveyed to a developing sleeve 100 serving as a developer bearing member by an agitating/conveying member, as illustrated in FIG. 6. The developing sleeve 100 incorporates a magnet 101 therein. The conveyed developer is borne on and conveyed by the rotating developing sleeve 100. And then, the developer is supplied to a photosensitive drum serving as an image bearing member in a state in which the thickness thereof is restricted by a developing blade 102 serving as a developer restricting member, thereby developing the electrostatic image formed on the photosensitive drum.

In the above-described developing device, any foreign matter has accidentally clogged at a position at which the developer borne on and conveyed by the developing sleeve 100 is restricted by the developing blade, thereby inhibiting formation of a layer of the developer. A quantity of the developer becomes smaller at that position of the inhibition, thereby raising a problem that fundamental development cannot be carried out.

In order to solve the problem, there has been proposed a method for fixing a member for vibrating the developing blade per se so as to remove foreign matters clogging in a gap defined between the developing blade and the developing sleeve (see Japanese Patent Application Laid-open No. 11-231645).

Incidentally, in the developing device for restricting the thickness of the layer by the developing blade 102, as described above, a portion A, at which a flow of the developer borne on and conveyed by the developing sleeve 100 is dammed by the developing blade 102, is generated at a developer sump 103. In contrast, the developer borne in the vicinity of the surface of the developing sleeve 100 is conveyed at substantially the same speed following the rotational speed of the developing sleeve 100. As a consequence, a shear surface is produced on the developer on a boundary between the dam portion A and a conveyance portion B, and then, a toner is liberated due to a difference in flow at the shear surface, resulting in formation of the layer of the developer at that portion. When the layer of the developer grows, the gap defined between the developing blade 102 and the developing sleeve 100 becomes smaller. The thickness of the layer of the developer formed on the developing sleeve 100 at a portion having the smaller gap becomes smaller than those at other portions. As a result, the developer provided for the development becomes smaller in quantity, thereby making an image pale. A study by the Inventors has found that this phenomenon is liable to occur in the case of the use of the two-component developer incorporating the toner and the carrier therein.

Furthermore, it has been found that the above-described phenomenon tends to cause the developer to be hardly consumed in the case of, in particular, a low printing ratio, to increase an aggregation degree of the developer due to liberation or embedding of an additive agent added into the developer, and to lead to the growth and marked generation of the layer of the developer.

In view of this, it is construed that the growth of the layer of the developer is suppressed by adopting a configuration in which the developing blade is vibrated, as disclosed in JP-A No. 11-231645. However, if the developing blade is vibrated in the case where an image is formed in a high printing ratio, the developer tends to fly more due to the vibrations. Moreover, the repeated vibrations induce contamination inside of a main body with the flying developer or adhesion of the flying developer to a recording sheet, thereby possibly degrading the quality of the image.

SUMMARY OF THE INVENTION

The present invention provides an image forming apparatus having developing means which vibrates a developer restricting member, thus suppressing degradation of an image and flying of a developer.

An image forming apparatus according to the present invention comprises: an image bearing member which bears a developer image thereon; a developing device which is provided with a rotatable developer bearing member for bearing a developer thereon, for developing an electrostatic image formed on the image bearing member with the developer; a developer restricting member which restricts a layer of the developer borne on the developer bearing member; a vibrating device which vibrates the developer restricting member; and a controller which controls a drive condition for the vibrating device in accordance with a printing ratio of an image formed with the developer.

Further features of the present invention will become apparent from the following description of exemplary embodiments with reference to the attached drawings.

DESCRIPTION OF THE EMBODIMENTS

First Exemplary Embodiment

Figure 1:
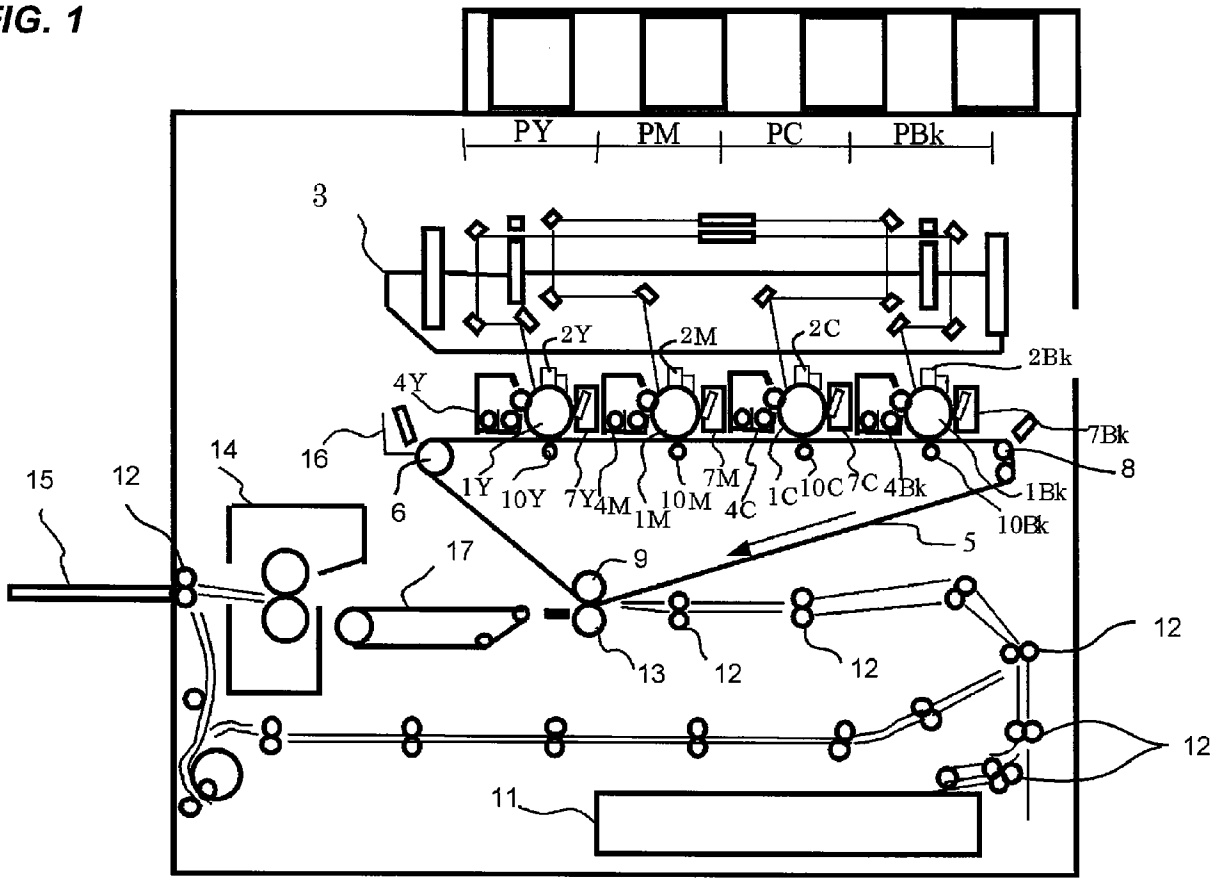
FIG. 1 is a view illustrating the general configuration of an image forming apparatus.
Figure 2:
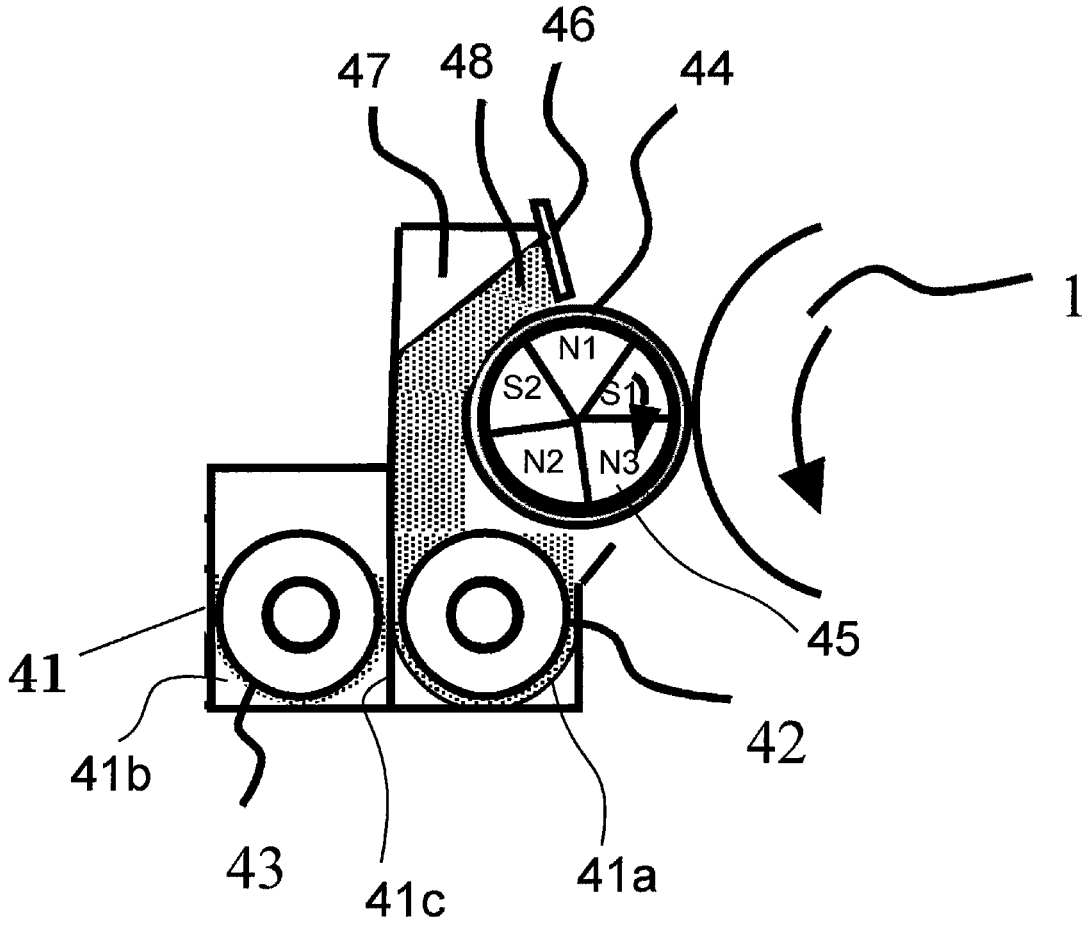
FIG. 2 is a cross-sectional view schematically illustrating a developing device.
Figure 3:
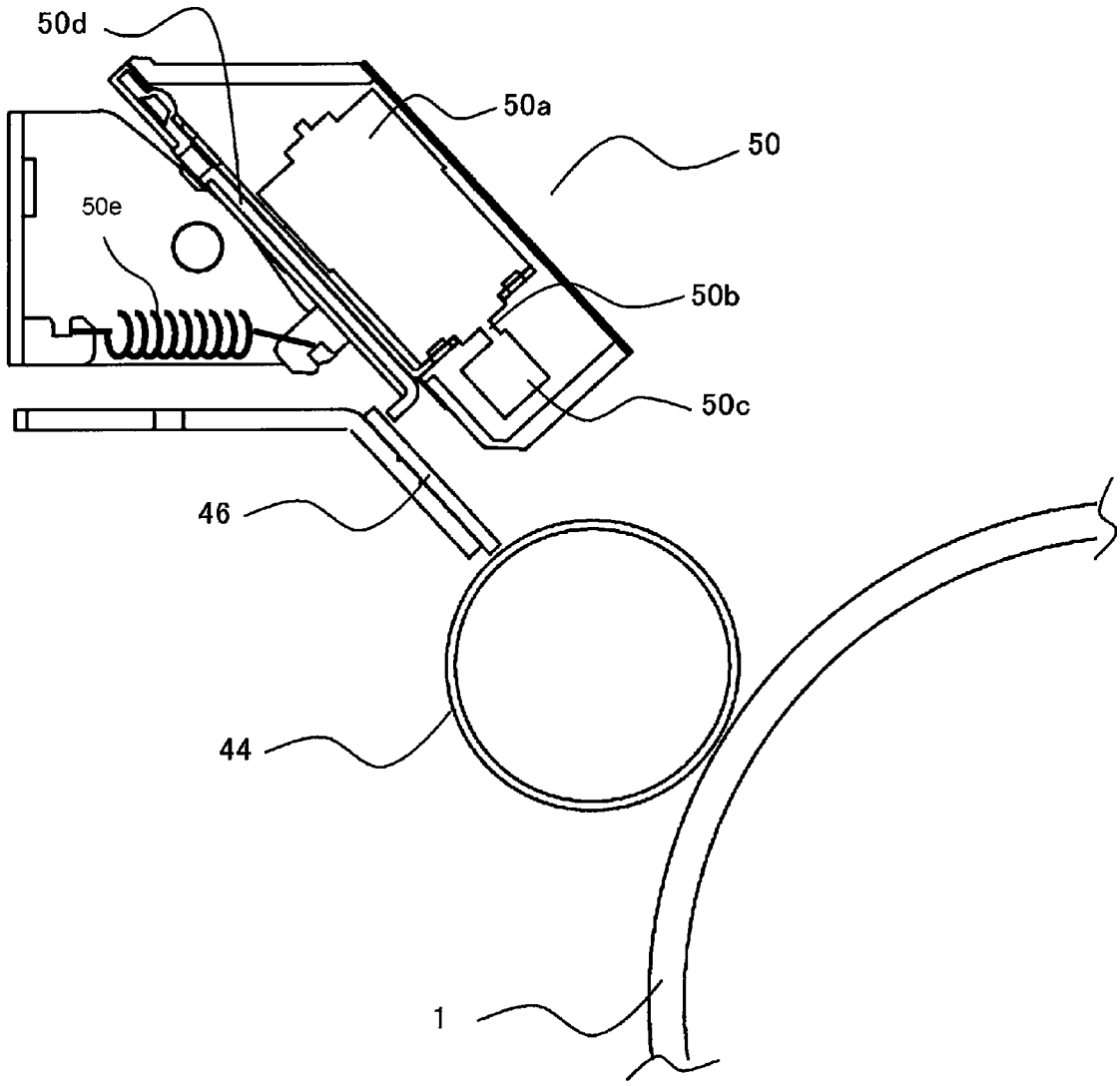
FIG. 3 is a cross-sectional view illustrating the constitution of vibrations of a developer bearing member.
Figure 4:
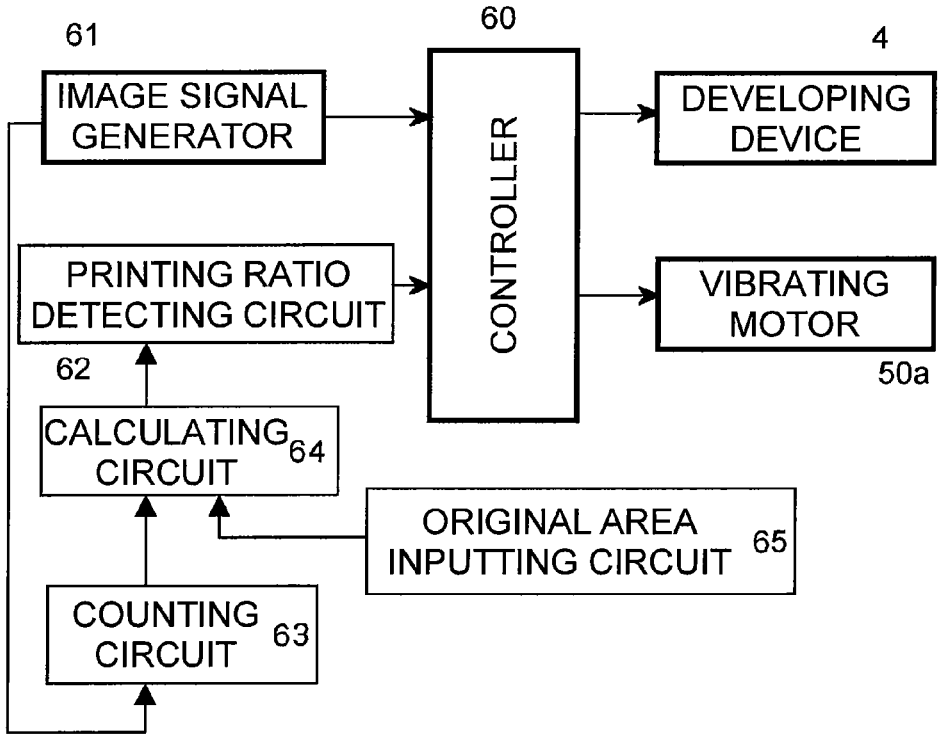
FIG. 4 is a block diagram illustrating a vibration control.
Figure 5:
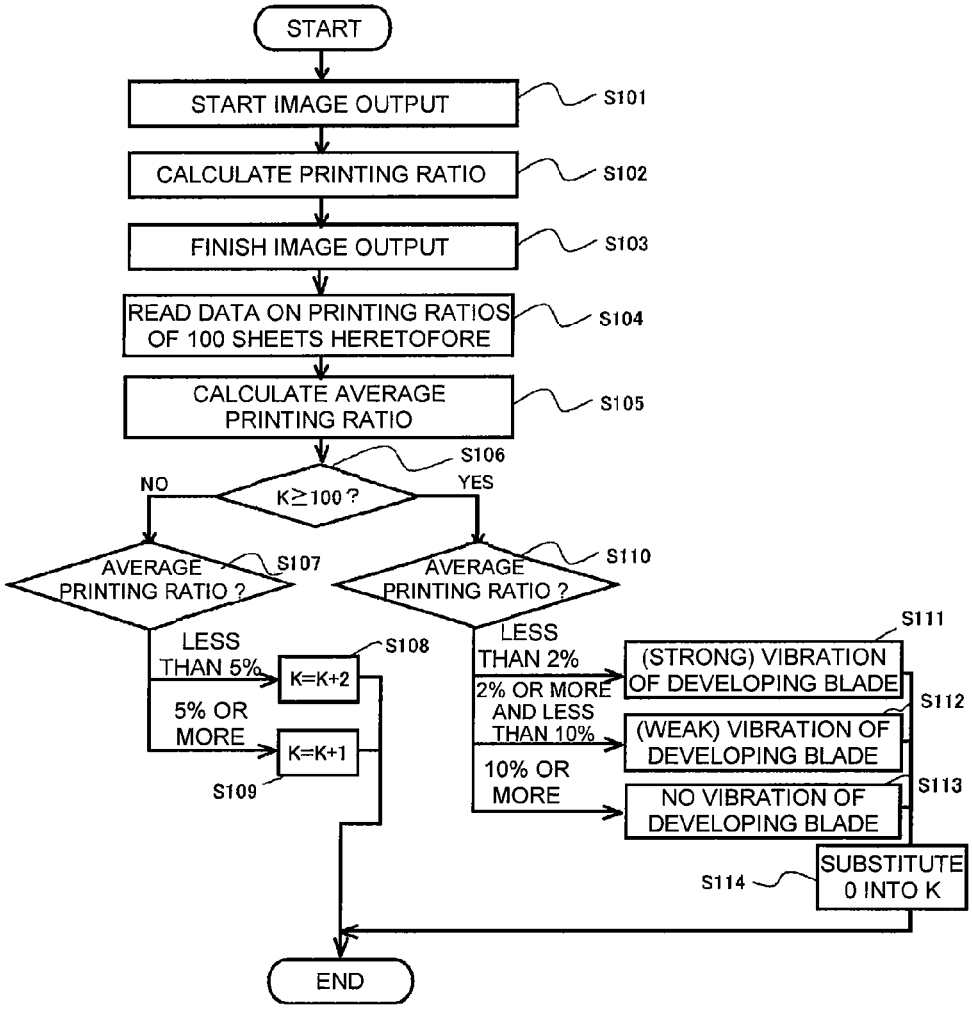
FIG. 5 is a flowchart illustrating vibration control procedures.
Figure 6:
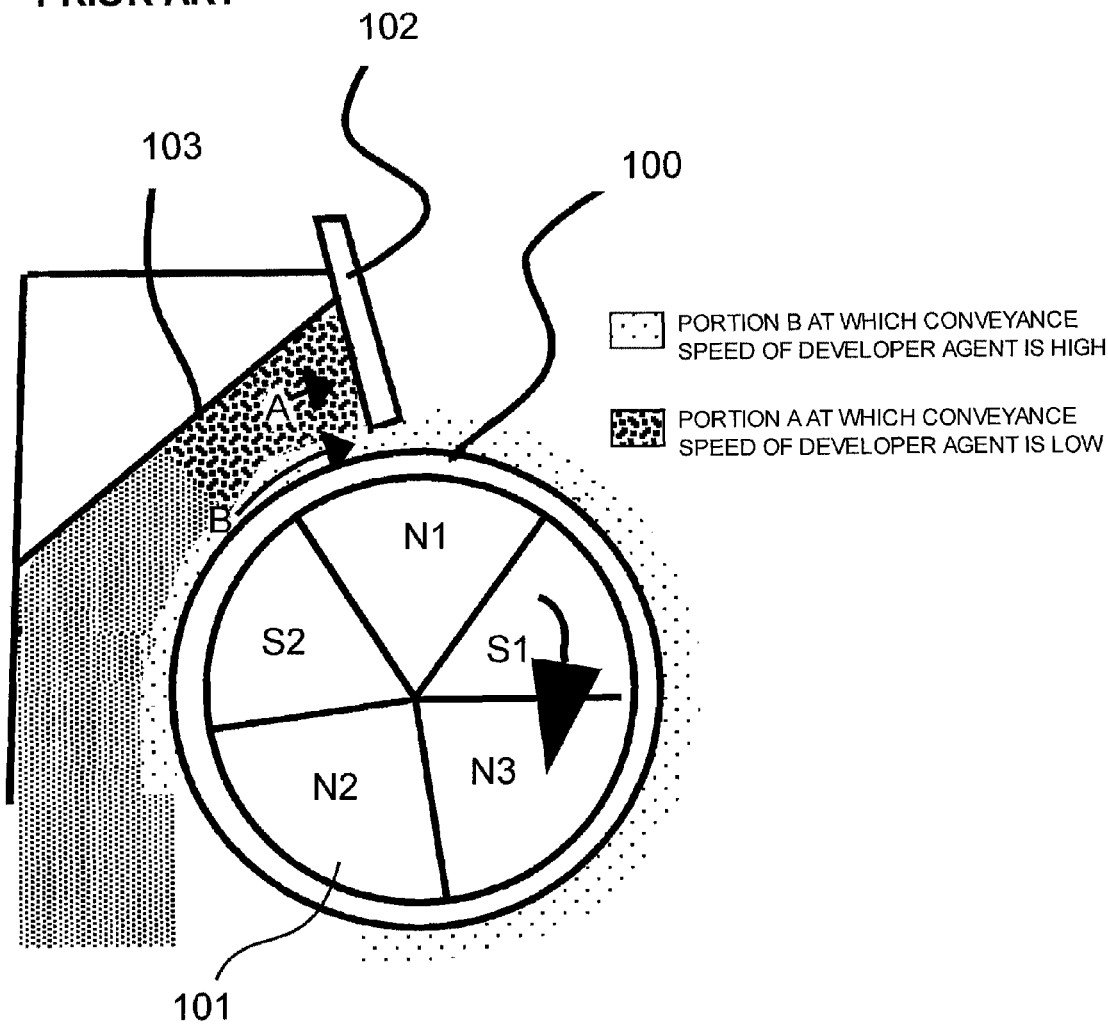
FIG. 6 PRIOR ART
FIG. 6 is a view illustrating the prior art.

FIGS. 1 to 5 illustrate an image forming apparatus in a first exemplary embodiment according to the present invention. FIG. 1 is a view illustrating the general configuration of an image forming apparatus, and FIG. 2 is a cross-sectional view schematically illustrating a developing device. FIG. 3 is a cross-sectional view illustrating the constitution of vibrations of a developer bearing member; FIG. 4 is a block diagram illustrating a vibration control; and FIG. 5 is a flowchart illustrating vibration control procedures.

[General Configuration of Image Forming Apparatus]

First of all, the general configuration of an image forming apparatus in the present exemplary embodiment will be described below together with an image forming operation in reference to FIG. 1.

The image forming apparatus in the present exemplary embodiment can form a full-color image of four colors, i.e., yellow (Y), magenta (M), cyan (C) and black (Bk) on a recording material by using an electrophotographic system in response to an image signal output from equipment such as an original reader connected to an apparatus body.

The image forming apparatus in the present exemplary embodiment is of a 4-rotation tandem type having first, second, third and fourth image forming portions PY, PM, PC and PBk for forming yellow, magenta, cyan and black images, serving as a plurality of image forming means. The configuration of each of image forming stations is substantially identical to each other except colors of developer agents. As a consequence, a description will be comprehensively given below by omitting subscripts Y, M, C and Bk assigned to reference numerals indicating constituent elements belonging to any one of the image forming stations as long as not specifically distinguished with each other.

Each of the image forming stations P includes a drum-like photosensitive member (i.e., a photosensitive drum) 1 serving as an image bearing member. Around the photosensitive drum 1 are arranged a charger 2, an exposing device 3, a developing device 4 serving as developing means and a cleaner 7. In addition, an intermediate transfer belt 5 is located in such a manner as to be brought into contact with each of the photosensitive drums 1. The intermediate transfer belt 5 is made of an endless belt member across a drive roller 6, tension rollers 8 and a transfer inner roller 9, to be rotated together with the photosensitive drums 1 during an image forming operation. Moreover, primary transfer rollers 10 are located at positions facing the photosensitive drums 1 while holding the intermediate transfer belt 5 therebetween.

In forming an image, a circumferential surface of the rotating photosensitive drum 1 is electrically charged in a uniform manner by the charger 2, and then, is selectively exposed to light by the exposing device 3, so that an electrostatic image is formed. The electrostatic image is made visible after being developed by the developing device 4. A toner image developed with the application of a bias to the primary transfer roller 10 is transferred onto the intermediate transfer belt 5. In this manner, a color image is formed by transferring the toner images in superimposition in the order of yellow, magenta, cyan and black colors.

In synchronism with the image formation, a sheet stacked in a cassette 11 loaded at a lower portion of the apparatus body is conveyed to a secondary transfer unit via pairs of conveying rollers 12. In the secondary transfer unit, the toner image on the intermediate transfer belt 5 is transferred onto the recording material with the application of a bias via a secondary transfer roller 13.

And then, the recording material having the toner image transferred thereonto is conveyed to a fixing device 14 by a conveying belt 17, followed by heating and fixing the toner image, to be discharged to a discharge tray 15.

Incidentally, adhering matters such as the toner remaining on the photosensitive drum 1 after the primary transferring process are collected by the cleaner 7. Meanwhile, adhering matters such as the toner remaining on the intermediate transfer belt 5 after the secondary transferring process are removed by an intermediate transferring member cleaner 16.

Here, the image forming apparatus in the present exemplary embodiment may form a monochromatic image, for example, a black image by using the image forming portion for a desired single color or a multi-color image by using the image forming portions for some colors out of the four colors.

[Developing Device]

Next, referring to FIG. 2, the configuration of the developing device in the exemplary embodiment according to the present invention will be described below in accordance with a developing operation.

A developer container 41 contains therein a two-component developer including a non-magnetic toner and a magnetic carrier. The inside of the developer container 41 is divided into a developing chamber 41*a* and an agitating chamber 41*b* via a partition wall 41*c* extending in a vertical direction. Inside of the developing chamber 41*a* and the agitating chamber 41*b* are housed developer conveying/agitating members 42 and 43, respectively. At both longitudinal ends of the partition wall 41*c* are delivering portions at which the developer is allowed to pass between the developing chamber 41*a* and the agitating chamber 41*b*. Each of the developer conveying/agitating members 42 and 43 conveys the developer while agitating it, thereby circulating it inside of the developer container 41. At a position facing the photosensitive drum 1 in the developer container 41 is rotatably disposed a developing sleeve 44 serving as a developer bearing member. The developing sleeve 44 contains therein a magnet 45 serving as magnetic field generating means.

The magnet 45 is constituted of three or more poles. The developer agitated by the developer conveying/agitating member 42 is restrained by a magnetic force of a conveying magnetic pole (i.e., a pumping pole) N2 for pumping, and then, is conveyed to a developer sump 48 in accordance with the rotation of the developing sleeve 44. The amount of developer is restricted by a developer returning member 47. In order to restrain the stable amount of developer, the developer is sufficiently restrained by a conveying magnetic pole (i.e., a cut pole) S2 having a certain magnetic flux density or more, and then, is conveyed while forming a magnetic brush. Subsequently, the amount of developer is optimized by cutting a magnetic brush tip by a developing blade 46 serving as a developer restricting member. Thereafter, the developer is conveyed by another conveying magnetic pole N1, to be conveyed to a position facing the photosensitive drum 1, followed by development by a developing pole S1.

Only the toner is transferred onto an electrostatic latent image formed on the photosensitive drum 1 owing to the developing bias applied to the developing sleeve 44 at the position facing the photosensitive drum 1, and thus, a toner image in accordance with the electrostatic image is formed on the photosensitive drum 1.

Here, as described above, the developer conveyed by the developing sleeve 44 and the developer dammed by the developing blade 46 define the shear surface in the vicinity of the developing blade 46. In this manner, the layer of the developer is formed due to a difference in flow at the shear surface on a side of the developing blade 46 for damming the developer, thereby narrowing a gap defined between the developing sleeve 44 and the developing blade 46.

In view of this, in the present exemplary embodiment, vibrations are applied to the developing blade 46 by vibrating means, so that the layer of the developer staying at the developer sump 48 in the vicinity of the developing blade 46 is loosened, to be discharged outside of the developing blade 46.

Consequently, it is possible to prevent any reduction of the amount of developer to be coated on the developing sleeve 44.

[Vibrating Means]

The vibrating means in the present exemplary embodiment is fixed to the developing blade 46, as illustrated in FIG. 3. The developing blade 46 is vibrated by driving the vibrating means 50. The vibrator 50 serving as the vibrating means includes a vibrating motor 50*a* inside of a case 50*d*, in which a weight 50*c* is fixed to an output shaft 50*b* of the vibrating motor 50*a*.

The vibrating motor 50*a* is securely housed inside of the case 50*d* in a state in which it is connected to a controller 60 (see FIG. 4) serving as control means. The case 50*d* is urged toward a supporter of the developing blade 46 via a spring 50*e*. The weight 50*c* is fixed in a state in which its center of gravity is eccentric from the output shaft 50*b*.

As a result, when the output shaft 50*b* of the vibrating motor 50*a* is rotationally driven by the control means, the vibrating motor 50*a* generates vibrations. The vibrations are propagated to the case 50*d*, and further, to the developing blade 46.

The case 50*d* is equipped with a function of preventing the developer from intruding into the vibrating motor 50*a* and a function of restraining the vibrating motor 50*a* so as to efficiently propagate the vibrations to the developing blade 46.

The vibrating means 50 having the above-described configuration is not limited to the above-described configuration as long as vibrations enough to remove a coagulated cluster can be applied to the developing blade 46.

[Vibration Control Configuration]

If the vibrations are unnecessarily applied to the developing blade 46, the developer flies in more quantity. In view of this, in the present exemplary embodiment, a printing ratio for the image formation is detected, and then, the drive condition of the vibrating means 50 is controlled based on the accumulation result.

FIG. 4 is a block diagram illustrating the configuration of control means for the above-described control. The controller 60 includes a CPU, a ROM and a RAM, to control the image formation or drive of the vibrating means 50. The controller 60 drives the exposing device 3 or the developing device 4 in response to an image signal output from an image signal generator 61 such as an original reader, to thus form the image. At this time, a printing ratio detecting circuit 62 detects a printing ratio of the image to be formed on the recording material in response to the image signal, followed by accumulation. The controller 60 controls the drive of the vibrating motor 50*a* under the set drive condition based on the result obtained by the printing ratio detecting circuit 62. The printing ratio herein signifies a rate of an actual image occupying a maximum image formation area. Incidentally, the maximum image formation area on a sheet of, for example, an A4 size connotes a predetermined region within the A4 size. A density signal in the image information signal input from the image signal generator 61 is accumulated as a number of video counts by a counting circuit 63. Then, the accumulated number of video counts is detected as a printing ratio by the printing ratio detecting circuit 62. Thereafter, a calculating circuit 64 receives the accumulated value. The calculating circuit 64 receives an area of an original, on which an image is formed, from an original area inputting circuit 65 at the same time in addition to the number of video counts, and then, calculates the number of video counts per unit area by dividing the number of video counts by the original area. The number of video counts corresponds to the quantity of the toner consumed in the developing device 4 in order to form the toner image, and therefore, the number of video counts per unit area corresponds to a printing ratio of the original. That is to say, as the number of video counts per unit area is greater, the printing ratio of the original is higher, so that the quantity of the toner consumed in one sheet of original is greater.

The above-described drive condition in the present exemplary embodiment is constituted such that a drive timing and a drive voltage of the vibrating motor 50*a* are changed according to the accumulated printing ratios. The drive timing herein signifies a timing at which the drive is started. A change in drive voltage varies the strength of vibrations by the vibrating motor. Vibration control procedures will be described in reference to a flowchart illustrated in FIG. 5. Here, FIG. 5 illustrates a processing flow per sheet of an image. In the case of sequential outputting, the processing illustrated in FIG. 5 is repeated with respect to each of the images.

First of all, an image output processing is started in S101 in FIG. 5. In S102, the printing ratio detecting circuit 62 calculates and accumulates the printing ratios in which the image formation is performed. And then, in S103, the image formation is performed.

Subsequently, in S104, data on printing ratios of past 100 sheets is read, and then, in S105, an average printing ratio is calculated. In S106, a variable K indicating the number of output sheets after the previous vibration processing in the developing blade 46 is read, and thereafter, it is checked as to whether or not the variable K is 100 or more.

If the variable K is 99 or less in S106, the average printing ratio calculated in S105 is checked in S107. If the average printing ratio is less than 5%, the variable K is added with 2 in S108 whereas if the average printing ratio is 5% or more, the variable K is added with 1 in S109, whereby the processing comes to an end.

In contrast, if the variable K is 100 or more in S106, the average printing ratio calculated in S105 is checked in S110. If the average printing ratio is less than 2%, a developing blade vibration (strong) mode, in which the drive voltage of the vibrating motor 50*a* is 5 V, is set in S111. Otherwise, if the average printing ratio is 2% or more and less than 10%, a developing blade vibration (weak) mode, in which the drive voltage of the vibrating motor 50*a* is 3 V, is set in S112. Alternatively, if the average printing ratio is 10% or more, no developing blade vibration mode is set in S113. Finally, the variable K is returned to 0 in S114, whereby the processing comes to an end.

As described above, the developing blade 46 is vibrated by driving the vibrating motor 50*a* when the number of image formed sheets reaches the set number. At this time, the printing ratio per image sheet is detected in counting the number of image sheets. If the printing ratio is lower than a predetermined value, the number of sheets is counted as two: in contrast, if the printing ratio is the predetermined value or higher, the number of sheets is counted as one. As a consequence, it is possible to efficiently inhibit the growth of the layer of the developer to be formed with the developer dammed by the developing blade 46.

In other words, when the consumption of the developer required for the image formation is small, the layer of the developer to be formed on the developing blade 46 is more liable to be formed than that when the consumption of the developer is large. In view of this, when the consumption of the developer is large (that is, the printing ratio is high), the developing blade 46 is vibrated by driving the vibrating motor 50*a* per formation of 100 image sheets, thereby eliminating the layer of the developer to be formed on the blade. In contrast, when the consumption of the developer is small (that is, the printing ratio is low), the developing blade 46 is vibrated by driving the vibrating motor 50*a* at a faster timing (that is, in a shorter frequency) than that when the consumption is large.

Consequently, the developing blade 46 can be vibrated according to the growth level of the layer of the developer to be formed on the developing blade 46. Therefore, the developing blade 46 cannot be unnecessarily vibrated, thereby suppressing the flying of the developer or the generation of a motor noise.

In the present exemplary embodiment, the strength of the vibration is varied by changing the motor driving voltage not only at the timing but also in the printing ratio as the drive conditions of the vibrating motor 50*a*. Specifically, the vibration is made strong in the case where the layer of the developer is liable to be formed on the developing blade 46 in the low printing ratio: in contrast, the vibration is made weak in the case where the layer of the developer is hardly formed on the developing blade 46 in the high printing ratio. Thus, it is possible to efficiently eliminate the layer of the developer to be formed on the developing blade 46.

Second Exemplary Embodiment

In the first exemplary embodiment, the strength of the vibration is varied by changing the drive voltage of the vibrating motor 50*a* in order to vary the strength of the developing blade vibration in S111 and S112 in the flowchart illustrated in FIG. 5. At this time, a drive time of the vibrating motor 50*a* as the drive condition may be varied. For example, a drive time of the vibrating motor 50*a* in the developing blade vibration (strong) processing in S111 is 2 seconds: in contrast, a drive time of the vibrating motor 50*a* in the developing blade vibration (weak) processing in S112 is 1 second. In this manner, an additional change in motor driving time can suppress the flying of the developer or the generation of the motor noise.

When the drive time of the vibrating motor as the drive condition is varied, only the drive time may be varied at a constant drive voltage. For example, the printing ratio is low, the drive time is set to be long: in contrast, the printing ratio is high, the drive time is set to be short. Even in this case, it is possible to efficiently eliminate the adhesive agent adhering to the blade.

Moreover, in the above-described exemplary embodiment, the drive condition of the vibrating motor 50*a* in each of the developing devices is the same. However, the development blade vibrating processing for each of the developing devices also may be independently performed by independently performing the image output processing sequence of each of the colors. In this manner, the developing blade vibrating processing can be efficiently performed according to the printing ratio per color.

According to the present invention, the developer adhering to the developer bearing member can be efficiently vibrated by changing the drive condition of the vibrating means based on the accumulation result of the printing ratios in which the images are formed heretofore in vibrating the developer restricting member. The developer restricting member cannot be unnecessarily vibrated, thus suppressing the flying of the developer to the minimum and the generation of the image degradation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-265028, filed Oct. 11, 2007, which is hereby incorporated by reference herein in its entirety.

What is claimed is:

1. An image forming apparatus comprising:

an image bearing member which bears a developer image thereon;

a developing device which is provided with a rotatable developer bearing member for bearing a developer thereon, for developing an electrostatic image formed on the image bearing member with the developer;

a developer restricting member which restricts a layer of the developer borne on the developer bearing member;

a vibrating device which vibrates the developer restricting member; and a controller which controls a drive condition for the vibrating device in accordance with a printing ratio of an image formed with the developer.

2. An image forming apparatus according to claim 1, comprising a plurality of the developing devices and a plurality of the vibrating devices corresponding to the developing devices, wherein the controller independently controls a drive condition for the corresponding vibrating device in accordance with the printing ratio of the image to be developed by each of the developing devices.

3. An image forming apparatus according to claim 1, wherein the controller increases a drive frequency of the vibrating device as the printing ratio of the image becomes lower.

4. An image forming apparatus according to claim 1, wherein the controller prolongs a drive period of the vibrating device as the printing ratio of the image becomes lower.

5. An image forming apparatus according to claim 1, wherein the controller increases a vibration strength of the vibrating device as the printing ratio of the image becomes lower.

* * * * *